US008186851B2

(12) United States Patent
Chang et al.

(10) Patent No.: US 8,186,851 B2
(45) Date of Patent: May 29, 2012

(54) FULL ANGLE LED ILLUMINATION DEVICE

(75) Inventors: Chia-Cheng Chang, Taipei County (TW); Rong-Ming Chang, Taipei County (TW)

(73) Assignee: Chia-Cheng Chang, Taipei County (TW)

( * ) Notice: Subject to any disclaimer, the term of this patent is extended or adjusted under 35 U.S.C. 154(b) by 367 days.

(21) Appl. No.: 12/628,790

(22) Filed: Dec. 1, 2009

(65) Prior Publication Data

US 2011/0128735 A1 Jun. 2, 2011

Related U.S. Application Data

(63) Continuation-in-part of application No. 12/614,968, filed on Nov. 9, 2009, now abandoned.

(51) Int. Cl.
*F21S 4/00* (2006.01)

(52) U.S. Cl. ..... 362/249.02; 362/249.03; 362/249.04; 362/249.06; 362/249.07; 362/249.08

(58) Field of Classification Search ..... 362/249.02–249.08, 249.14, 646, 362/311.02

See application file for complete search history.

(56) References Cited

U.S. PATENT DOCUMENTS

| | | | | |
|---|---|---|---|---|
| 7,494,250 | B2 * | 2/2009 | Chen | 362/294 |
| 7,726,836 | B2 * | 6/2010 | Chen | 362/249.02 |
| 7,857,486 | B2 * | 12/2010 | Long et al. | 362/294 |
| 2011/0019421 | A1 * | 1/2011 | Lai | 362/249.06 |
| 2011/0110089 | A1 * | 5/2011 | Chang et al. | 362/249.06 |

* cited by examiner

*Primary Examiner* — Stephen F Husar
*Assistant Examiner* — James Cranson, Jr.
(74) *Attorney, Agent, or Firm* — Muncy, Geissler, Olds & Lowe, PLLC

(57) ABSTRACT

A full angle LED (light-emitting diode) illumination device comprises at least three copper base plates, a plurality of LED chips, and a flexible circuit layer. Each copper base plate is electroplated with a layer of silver thereon and the copper base plates are arranged in a crisscross pattern to form the backbone of a three-dimensional globe. Each LED chip is provided on the external surface of the three-dimensional globe at a site where any two copper base plates are criss-crossed. The flexible circuit layer is provided on the peripheries of the copper base plates and electrically connected with the LED chips for controlling the LED chips. Accordingly, it is able to provide full angle illumination range and to improve the thermal conductivity and heat dissipation capability in order to prolong effectively the lifetime of the LED chips in use.

4 Claims, 2 Drawing Sheets

FULL ANGLE LED ILLUMINATION DEVICE

CROSS REFERENCE TO RELATED APPLICATION

This application is a continuation-in-part of application Ser. No. 12/614,968, filed Nov. 9, 2009, the entire contents of which are hereby incorporated by reference.

TECHNICAL FIELD

The present invention relates to a LED (light-emitting diode) illumination device and, more particularly, to a full angle LED illumination device capable of providing full angle illumination range and having improved thermal conductivity and heat dissipation capability in order to prolong the lifetime of the LED chips in use.

BACKGROUND

Typically, a plurality of LEDs (light-emitting diodes) are arranged on the same plane of a main body to form a conventional LED illumination device in order to provide wider illumination range and better illumination intensity. By using above planar type LED illumination devices, it is able to obtain 180-degree illumination range after the LEDs are driven.

Although 180-degree illumination range can be achieved by means of above LED arrangement, the practical illumination effect provided by above LED illumination devices is not ideal. In order to widen the illumination range, two planar type LED illumination devices are combined to form a new device, the illumination of which is almost 360 degree.

However, it is also disadvantageous in several aspects to combine two planar type LED illumination devices mentioned hereinabove.

First of all, dead angles still exist even two planar type LED illumination devices are combined and it is unable to achieve 360-degree illumination range. Second, the assembling cost for combining two planar type LED illumination devices is greatly increased. Besides, assembling two planar type LED illumination devices not only requires highly complicated and difficult technical skills but also takes much longer time. Moreover, the yield of the devices produced by assembling two planar type LED illumination devices is low as well.

In order to overcome above shortcomings, inventor had the motive to study and develop the present invention. After hard research and development, the inventor provides a full angle LED illumination device advantageous in providing full angle illumination range, having lower manufacturing cost, and having improved thermal conductivity and heat dissipation capability in order to prolong the lifetime of the LED chips in use.

SUMMARY OF THE DISCLOSURE

An object of the present invention is to provide a full angle LED (light-emitting diode) illumination device, which is made by arranging plural copper base plates in a crisscross pattern to form the backbone of a three-dimensional globe and providing LED chips on the external surface of the three-dimensional globe at sites where any two copper base plates are crisscrossed. Thereby, LED chips are able to illuminate in different angle ranges in order to eliminate dead angles and achieve three-dimensional illumination effect.

Another object of the present invention is to provide a full angle LED illumination device, where each copper base plate is electroplated with a layer of silver thereon. Thereby, thermal conductivity and heat dissipation capability can be improved in order to prolong the lifetime of the LED chips in use while to keep the manufacturing cost low.

In order to achieve above objects, the present invention provides a full angle LED illumination device comprising at least three copper base plates, a plurality of LED chips, and a flexible circuit layer. The copper base plates are arranged in a crisscross pattern to form the backbone of a three-dimensional globe and each copper base plate is electroplated with a layer of silver thereon. Each LED chip is provided on the external surface of the three-dimensional globe at a site where any two copper base plates are crisscrossed. The flexible circuit layer is provided on the peripheries of the copper base plates and electrically connected with the LED chips for controlling the LED chips. Accordingly, it is able to provide full angle illumination range and to improve the thermal conductivity and heat dissipation capability in order to prolong the lifetime of the LED chips in use effectively.

In practice, the full angle LED illumination device preferably includes three copper base plates and six LED chips. The copper base plates are arranged to be vertical to each other to form the backbone of a three-dimensional globe while the LED chips are provided on the external surface of the three-dimensional globe at sites where any two copper base plates are crisscrossed.

The following detailed description, given by way of examples or embodiments, will best be understood in conjunction with the accompanying drawings.

DETAILED DESCRIPTION

The present invention discloses a full angle LED (light-emitting diode) illumination device comprising at least three copper base plates, a plurality of LED chips, and a flexible circuit layer. The copper base plates are arranged in a crisscross pattern to form the backbone of a three-dimensional globe. Each LED chip is provided on the external surface of the three-dimensional globe at a site where any two copper base plates are crisscrossed. The flexible circuit layer is provided on the peripheries of the copper base plates and electrically connected with the LED chips for controlling the LED chips.

Figure 1:
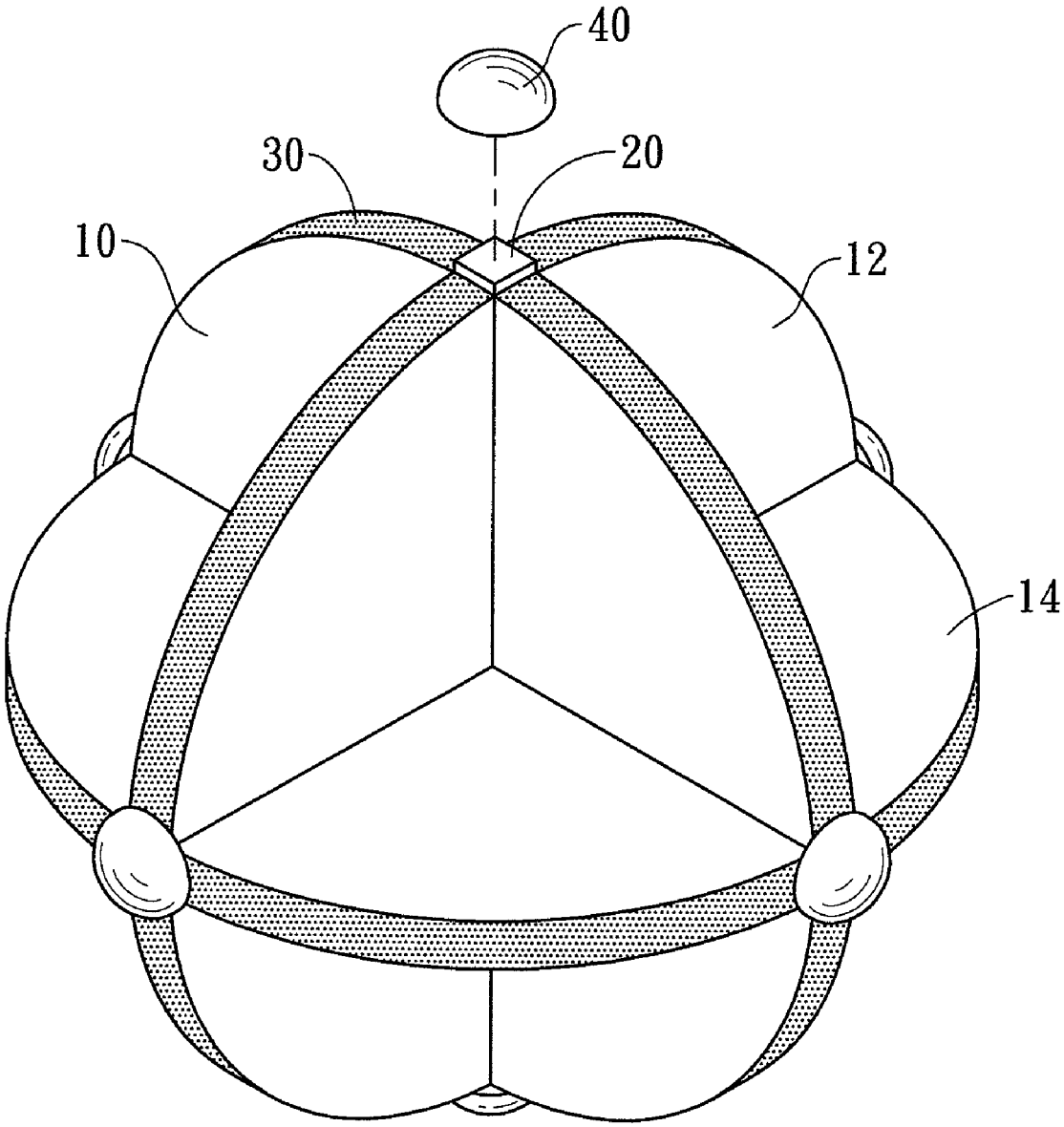
FIG. 1 shows a perspective view of a full angle LED illumination device of the present invention.
Figure 2:
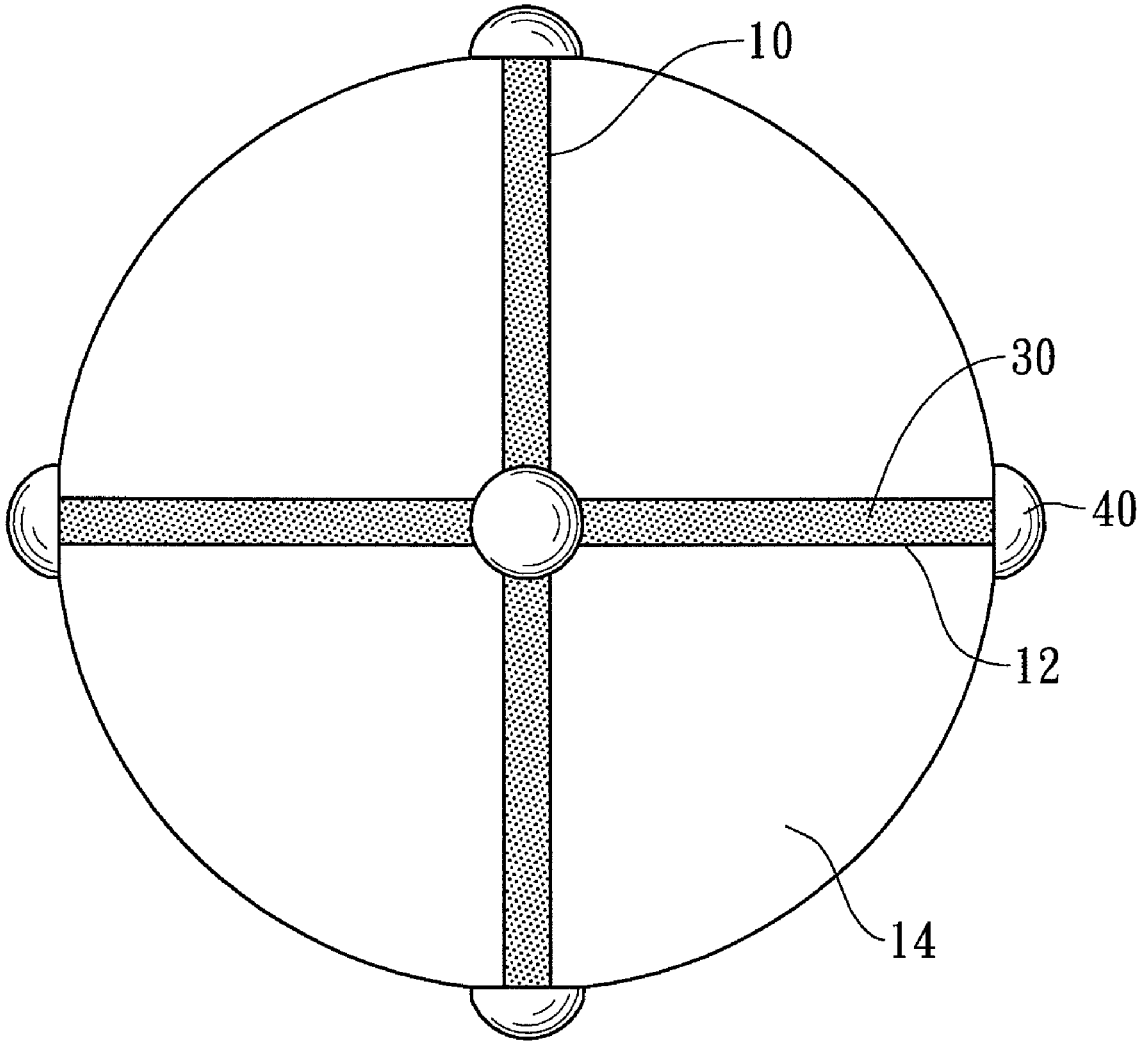
FIG. 2 shows a top view of the full angle LED illumination device of the present invention.

Please refer to FIGS. 1 and 2 showing a preferred embodiment of the full angle LED illumination device of the present invention. In this embodiment, the full angle LED illumination device comprises three copper base plates 10, 12, 14, six LED chips 20, six covers 40, and a flexible circuit layer 30.

The copper base plates 10, 12, 14 are arranged to be vertical to each other to form the backbone of a three-dimensional globe. Above copper base plates can be assembled by means of using any method. Besides. Each copper base plate 10, 12, 14 is electroplated with a layer of silver thereon in order to obtain optimal thermal conductivity and heat dissipation capability.

Heat will be inevitably produced when LED chips are used. If the produced heat is unable to dissipate effectively, the temperature of the LED chips will be elevated accordingly, which may shorten the lifetime of the LED chips. In order to solve this problem and prolong the lifetime of LED chips, metal is typically used to dissipate produced heat because of good thermal conductivity and heat dissipation capability.

In this embodiment, copper and silver are used as the material to solve the problem regarding thermal conductivity and heat dissipation. The thermal conductivity coefficient of copper is 380 W/m.K while the thermal conductivity coefficient of silver is 429 W/m.K. Accordingly, silver has better thermal conductivity when compared with copper. However, copper is much cheaper than silver.

Therefore, in the present invention, the copper is used as a core for thermal conductivity and heat dissipation and silver is electroplated on the surface of the core made of copper. In other words, copper and silver are used to form an alloy whose thermal conductivity is between those of copper and silver. Accordingly, better thermal conductivity and hear dissipation capability can be achieved while the cost can be kept low.

In practice, the thermal conductivity coefficient of the copper base plate electroplated with a layer of silver is about 420 W/m.K. That is, the thermal conductivity of the copper base plate electroplated with a layer of silver is almost the same with that of silver while the cost of the electroplated copper base plate is much cheaper than that of silver. Besides, in addition to the better thermal conductivity and hear dissipation capability, the silver electroplated on the copper base plate is also able to provide reflection effect that is beneficial to increase effective luminous flux.

Each LED chip 20 is provided on the external surface of the three-dimensional globe at a site where any two copper base plates are crisscrossed and is covered with a cover 40. Thereby, the LED chips are able to illuminate in different angle ranges. Consequently, it is able to obtain full angle illumination range and eliminate dead angles effectively.

In this embodiment, the flexible circuit layer 30 is provided on the peripheries of the copper base plates 10, 12, 14 and electrically connected with the LED chips 20 for controlling and operating the LED chips 20.

Therefore, the present invention has following advantages:

1. By arranging at least three copper base plates in a crisscross pattern to form the backbone of a three-dimensional globe and disposing each LED chip on the external surface of the three-dimensional globe at a site where any two copper base plates are crisscrossed, it is able to obtain full angle illumination range and effectively eliminate dead angles.
2. The alloy formed by electroplating a layer of silver on the surface of a copper base plate has ideal thermal conductivity and heat dissipation capability and low manufacturing cost.
3. By electroplating a layer of silver on the surface of a copper base plate, the electroplated silver can provide better reflection effect in order to increase the effective luminous flux.

As disclosed in the above description and attached drawings, the present invention can provide a full angle LED illumination device capable of providing full angle illumination range and advantageous in having improved the thermal conductivity and heat dissipation capability in order to prolong the lifetime of the LED chips in use while keeping the manufacturing cost low. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A full angle LED (light-emitting diode) illumination device, comprising:

at least three copper base plates, where each copper base plate is electroplated with a layer of silver thereon, and the copper base plates are arranged in a crisscross pattern to form backbone of a three-dimensional globe;

a plurality of LED chips, each of which is provided on external surface of the three-dimensional globe at a site where any two copper base plates are crisscrossed; and a flexible circuit layer, provided on peripheries of the copper base plates and electrically connected with the LED chips for controlling the LED chips.

2. The full angle LED illumination device as claimed in claim 1, wherein each LED chip is further covered by a cover.

3. The full angle LED illumination device as claimed in claim 1, comprising three copper base plates and six LED chips, wherein the copper base plates are arranged to be vertical to each other to form the backbone of a three-dimensional globe; the LED chips are provided on the external surface of the three-dimensional globe at sites where any two copper base plates are crisscrossed.

4. The full angle LED illumination device as claimed in claim 3, wherein each LED chip is further covered by a cover.

* * * * *